United States Patent [19]

Logsdon

[11] Patent Number: 4,839,968

[45] Date of Patent: Jun. 20, 1989

[54] GOLF GREEN VIEWING APPARATUS

[76] Inventor: Hubert E. Logsdon, 501 E. Market St., Salem, Ind. 47167

[21] Appl. No.: 145,267

[22] Filed: Jan. 19, 1988

[51] Int. Cl.[4] ..... G01B 9/00

[52] U.S. Cl. ..... 33/286; 273/183 E; 273/35 A; 356/255

[58] Field of Search ..... 33/137 R, 286, 289, 33/293, 295, 274, 296, 297; 273/183 E, 35 A, 32 H, 32 R; 356/255

[56] References Cited

U.S. PATENT DOCUMENTS

| | | | |
|---|---|---|---|
| 2,463,291 | 3/1949 | Mazziotti | 356/255 X |
| 2,463,798 | 3/1949 | Paisley | 33/289 X |
| 2,822,614 | 2/1958 | Susino | 356/255 X |
| 3,118,678 | 1/1964 | Rohr | 356/255 X |
| 3,170,698 | 2/1965 | Schoeffler et al. | 356/255 X |
| 3,198,525 | 8/1965 | Smith | 356/255 X |

*Primary Examiner*—William D. Martin, Jr.
*Attorney, Agent, or Firm*—Leon Gilden

[57] ABSTRACT

A golf green indication means is set forth for visual reflection of a golf green surface and visually illustrate slope and obstructions associated in the path of a ball proximate a putting hole. A reflective lens is fastened to a housing to present an acute angle of approximately 45 degrees relative to the golf green surface. An associated handle to the housing enables easy transport of the device in use.

1 Claim, 3 Drawing Sheets

GOLF GREEN VIEWING APPARATUS

BACKGROUND OF THE INVENTION

1. Field of the Invention

The present invention relates to golfing apparatus and accessories associated with the game of golf and more particularly pertains to a new and improved golf green reading apparatus for visual indication of slope and imperfections presented before the path of a golf ball and an objective putting hole.

2. Description of the Prior Art

The use of golf green reading apparatus is well known in the prior art. As may be appreciated, these devices have been of elaborate or awkward construction its use and effectiveness.

In this connection, there have been several attempts to develop golf green reading devices which may be easily and efficiently transported as desired for use with associated golf greens. For example, U.S. Pat. No. 3,186,092 to Bertas utilizes an optical device for reading golf greens attachable to an associated golf club including a transparent member with a horizontal reference line for indicating slope of a golf green for intended putting purposes. The Bertas patent requires a steady manual securement of a golf club and is oriented at an elevation above a putting surface to limit its effectiveness in reading golf green slope at the golf ball level and for indicating obstructions that may be present between a golf ball and an intended path of the golf ball to an objective putting hole.

U.S. Pat. No. 3,306,618 to Liljaquist utilizes a golf club in combination with a slope indication means permanently secured within a cavity formed within the golf club. Essentially, the Liljaquist patent presents a liquid-filled chamber for providing information relative to ground slope at a particular point and is not effective for visual indication of ground contour between a golf ball and an objective golf hole.

U.S. Pat. No. 3,751,819 to Dixon utilizes a golf club shaped apparatus essentially comprising a bubble level indicating device for reference of appropriate slope of a green at a particular positioning of the apparatus and in this context, it is similar to the Liljaquist patent and its associated deficiencies.

U.S. Pat. No. 3,915,457 to Casey utilizes an angulated mirror with a figure superimposed thereon for assisting a golf trainee in appropriate form during a golf swing and is of interest only relative to a general configuration but is of remote substantive and functional structure as related to the instant invention.

U.S. Pat. No. 4,260,151 to Weaver sets forth a hand-held sign device for golfers in determining sloping of putting greens wherein a suspended indicator needle within a housing provides reference deviation to a datum of a particular putting green's slope.

As such, it may be appreciated that there is a continuing need for a new and improved golf green reading apparatus which addresses both the problem of portability and effectiveness, and in this respect, the present invention substantially fulfills this need.

SUMMARY OF THE INVENTION

In view of the foregoing disadvantages inherent in the known types of golf green reading devices now present in the prior art, the present invention provides a golf green reading apparatus wherein the same may be readily transported during periods of non-use and may be further easily and efficiently positioned for effective golf green reading. As such, the general purpose of the present invention, which will be described subsequently in greater detail, is to provide a new and improved golf green reading apparatus which has all the advantages of the prior art golf green reading devices and none of the disadvantages.

To attain this, the present invention comprises a ground supportable housing wherein a positioned reflective surface, such as a mirror, presents an acute angle between the positioned surface of the mirror and the bottom surface of the housing for visual ascertainment of putting green slopeage and obstructions, as may be presented between a golf ball and an objective hole. An integral handle enables ready and instant portage of the device from one golf green to another to facilitate its movement.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf green reading apparatus which has all the advantages of the prior art golf green reading apparatus and none of the disadvantages.

It is another object of the present invention to provide a new and improved golf green reading apparatus which may be easily and efficiently manufactured and marketed.

It is a further object of the present invention to provide a new and improved golf green reading apparatus which is of a durable and reliable construction.

An even further object of the present invention is to provide a new and improved golf green reading apparatus which is susceptible of a low cost of manufacture with regard to both materials and labor, and which accordingly is then susceptible of low prices of sale to the consuming public, thereby making such golf green reading apparatus economically available to the buying public.

Still yet another object of the present invention is to provide a new and improved golf green reading apparatus which provides in the apparatuses and methods of the prior art some of the advantages thereof, while simultaneously overcoming some of the disadvantages normally associated therewith.

Still another object of the present invention is to provide a new and improved golf green reading apparatus wherein a reflective mirror is positioned on a ground supported housing for visual appreciation of golf green slopeage and potential obstructions between a golf ball and intended golf hole.

Yet another object of the present invention is to provide a new and improved golf green reading apparatus wherein a housing secures a mirror at a relative acute angle of approximately 45 degrees for ready and effective visual appreciation of potential obstructions and ground slopeage between a golf ball and an intended golf hole.

Even still another object of the present invention is to provide a new and improved golf green reading apparatus with an associated integral handle enabling effective transport of the apparatus from one site to another.

There together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
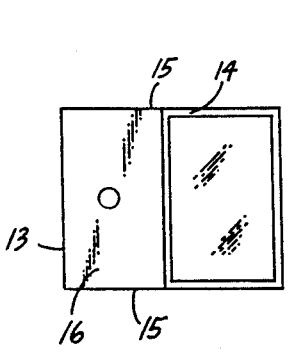
FIG. 1 is a top orthographic view of the instant invention.
Figure 2:
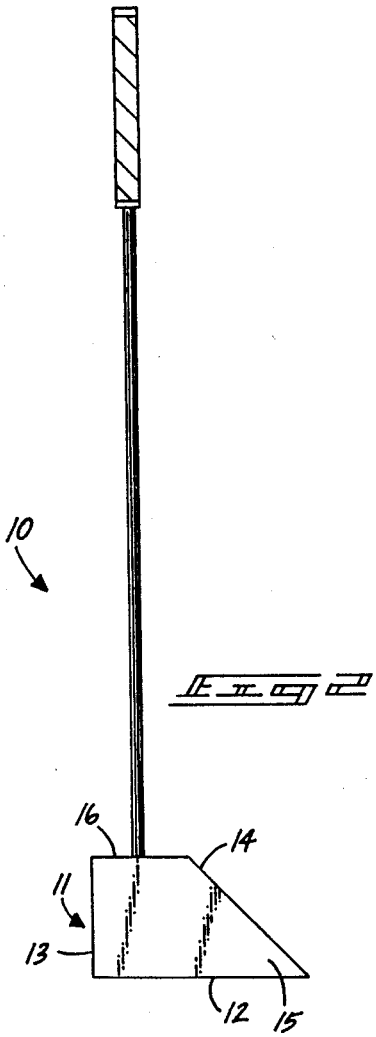
FIG. 2 is a side orthographic view taken in elevation of the instant invention.
Figure 3:
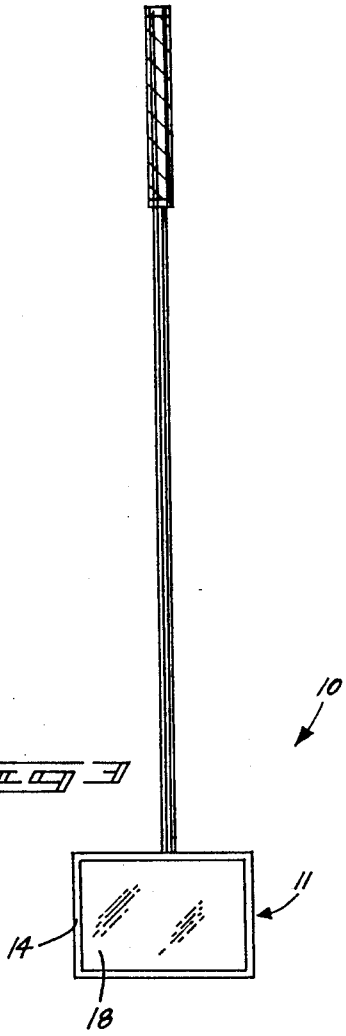
FIG. 3 is a forward orthographic view taken in elevation of the instant invention.
Figure 4:
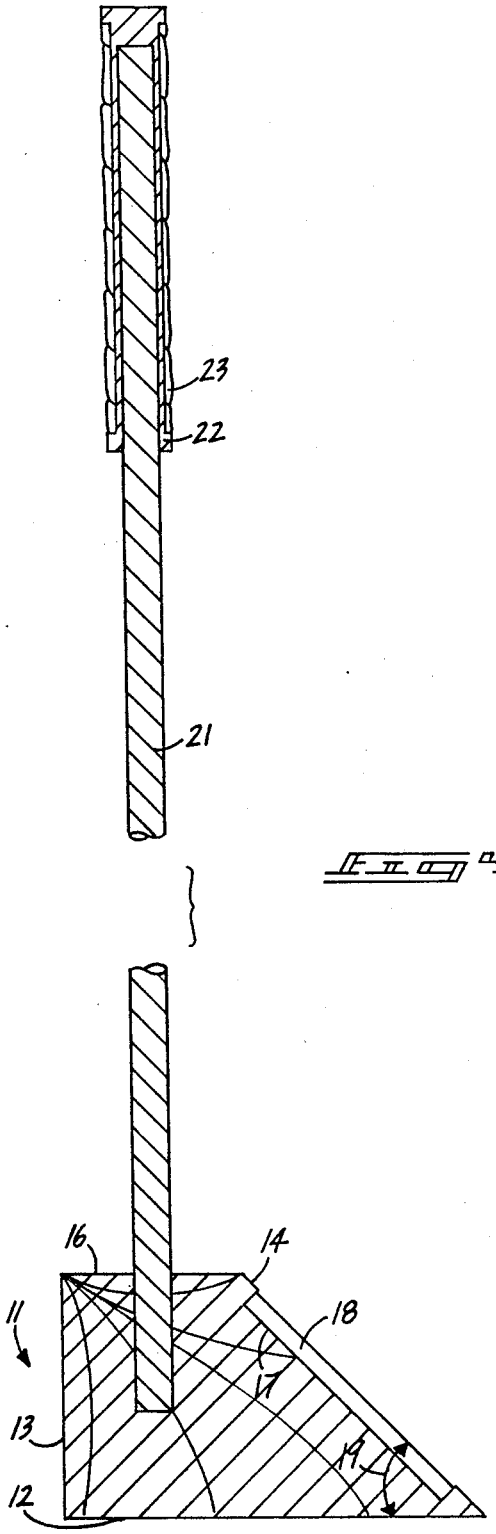
FIG. 4 is an orthographic cross-sectional elevational view of the instant invention illustrating the various components, their configurations, and relationship.

With reference now to the drawings, and in particular to FIGS. 1 to 5 thereof, a new and improved golf green reading apparatus embodying the principles and concepts of the present invention and generally designated by the reference numeral 10 will be described.

More specifically, it will be noted that the golf green reading apparatus 10 essentially comprises a housing 11 formed with a bottom support surface 12 for positioning on a golf green with a rear surface 13, and forward inclined rectangular framing surface 14, a top surface 16 and generally trapezoidal sides 15. A cavity 17 securedly encompasses and accepts a mirror element 18 therein, as may be seen in FIG. 4. Housing 11 may be formed of any appropriate rigid material such as wood, metal, etc., wherein mirror element 18 may be formed of conventional glass or preferably of impact resistant materials, such as those of polymeric origin. Mirror 18 is inclined at a relatively acute angle to bottom support surface 12 and is preferably of 45 degrees, as indicated by included angle in between the exterior surface of mirror 18 and bottom surface 12, and accordingly enable an observer an effective view of ground pitch or slope and of any potential impediments between an associated golf ball and the objective golf hole, as indicated in FIG. 5.

Figure 5:
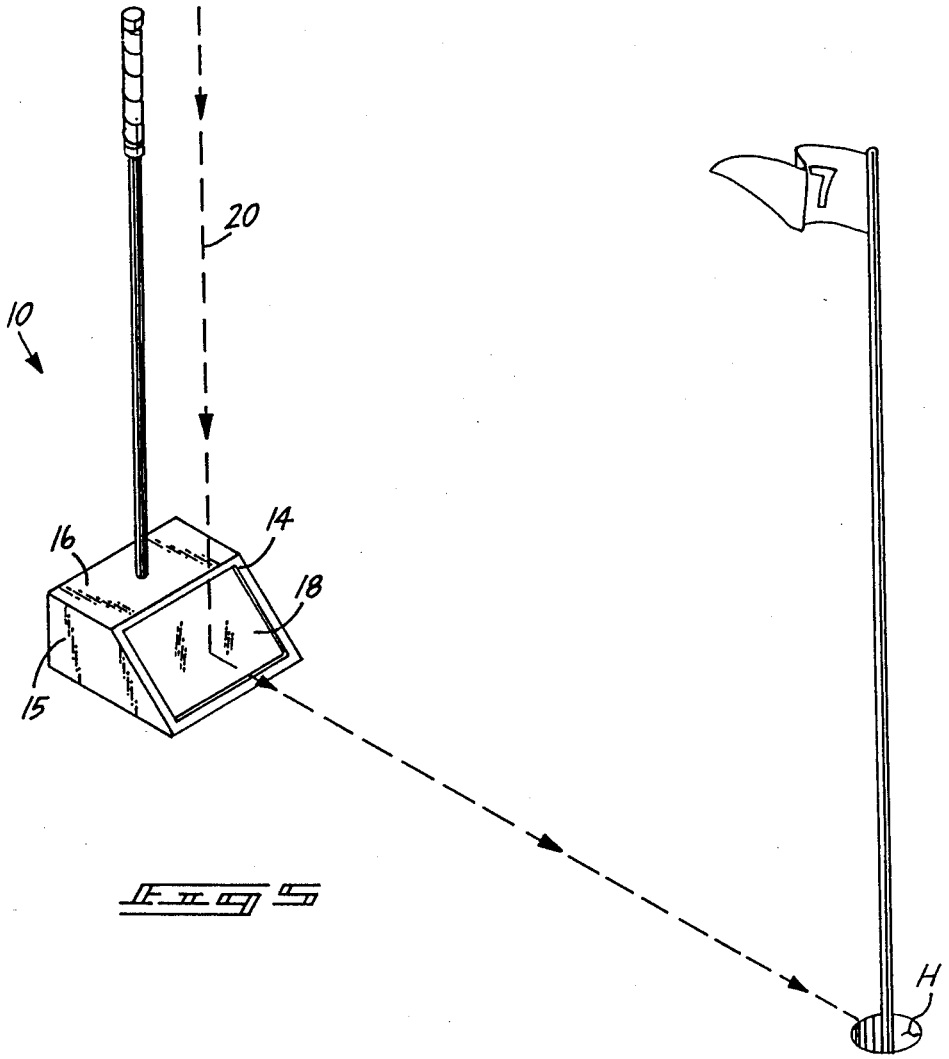
FIG. 5 is an isometric view of the instant invention illustrating the relationship of the invention with respective to objective golf hole.

The golf green reading apparatus 10 is effective within 8 feet of the objective golf hole indicated as "H" in FIG. 5 and accordingly, while a 45 degree angle is indicated per 19; angles may be utilized between 30 and 60 degrees but would require a different orientation of observation rather than the orthogonal relationship with the line of site 20 per FIG. 5 and the putting green upon which the green reading apparatus 10 is supported.

A handle secured within housing 11 is formed of a rigid shaft 21 with a handle core 22 secured at its upper terminal end with a non-slip material 28 forming a gripping surface.

In use, a golfer merely positions the golf green reading apparatus 10 proximate the lie of the golf ball and an overlying relationship to mirror element 18 views along sighting line 20 orthogonally to the putting green supporting the apparatus 10 and may at that juncture observe the slope of a putting green between a golf ball and an objective golf hole "H". Simultaneously, any obstructions or impediments between a golf ball and hole "H" may be readily observed and utilized by an observer for calculation of an appropriate approach to golf "H".

With respect to the above description then, it is to be realized that the optimum dimensional relationships for the parts of the invention, to include variations in size, materials, shape, form function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf green reading apparatus for enabling visual observation of golf green slope and obstruction between a position on said green remote from objective hole and said hole comprising, a housing means for support of a reflective observing surface, said housing means including a bottom support surface, a forward surface, and a top surface; and a handle means orthogonally secured to said housing means for transport of said housing means; and wherein an included angle between said bottom support surface and said forward surface is an acute angle of forty-five degrees; and wherein said housing means includes sides; said sides being of trapezoidal configuration; and wherein said forward surface has a recess formed therein wherein said recess and said reflective observing surface are of complementary shape; and wherein said forward surface forms a rectangular framework about said observing surface; and wherein said handle includes an elongate shaft with a handle core secured in an upward terminal end thereof with a non-slip handle surface secured about said core; and wherein said support surface is planar for positioning on said green and of greater surface area than said top surface to impart stability to said apparatus.

* * * * *